US005816981A

United States Patent [19]

Hung

[11] Patent Number: 5,816,981

[45] Date of Patent: Oct. 6, 1998

[54] FOLDABLE EXERCISE TREADMILL STRUCTURE

[76] Inventor: Michael Hung, 9-16, Nan Kan Hsia, Nan Kan, Lu Chu Hsiang, Tao Yuan County, Taiwan

[21] Appl. No.: 848,834

[22] Filed: May 5, 1997

[51] Int. Cl.[6] ..... A63B 22/02

[52] U.S. Cl. ..... 482/54

[58] Field of Search ..... 482/54

[56] References Cited

U.S. PATENT DOCUMENTS

| | | | |
|---|---|---|---|
| 931,394 | 8/1909 | Day | 482/54 |
| 4,066,257 | 1/1978 | Moller | 482/54 |
| 4,679,787 | 7/1987 | Guilbault | 482/54 |
| 4,757,987 | 7/1988 | Allemand | 482/54 |
| 5,662,557 | 9/1997 | Watterson et al. | 482/54 |

*Primary Examiner*—Lynne A. Reichard

*Attorney, Agent, or Firm*—Wenderoth, Lind & Ponack

[57] ABSTRACT

The invention targets at providing a foldable structure for a conventional exercise treadmill, especially for a exercise treadmill that has a motor mounted in the front and fixed type armrests. According to the invention the main frame of the exercise treadmill is provided at the front end with a U-shaped base to which armrests are attached. Further, a pressure rod and a telescopic support tube are disposed on two sides of the U-shaped base and the main frame. To fold the exercise treadmill, users lift the rear end of the main frame to a predetermined inclination and then by means of the release of the pressure energy of the pressure rod the main frame will automatically move to an upright folded position juxtaposed with the armrests. Hence the exercise treadmill structure of the invention can reduce the space it occupies when not in use for convenience in storage or delivery. Furthermore, the spread structure can be firmly fixed by a movable steel ball of the support tube.

3 Claims, 4 Drawing Sheets

FOLDABLE EXERCISE TREADMILL STRUCTURE

BACKGROUND OF THE INVENTION (a) Field of the Invention

The present invention relates to a foldable exercise treadmill structure that is an improved design of a conventional exercise treadmill having a motor in the front of a main frame and fixed armrests.

(b) Description of the Prior Art

In a conventional exercise treadmill structure, the armrests are attached to a main frame by screws or welding so that the entire structure can not be bent over itself for a reduction in volume, causing inconvenience in packing, shipping, and storage.

SUMMARY OF THE INVENTION

The primary object of the invention is to provide a foldable exercise treadmill structure that is an improved space saving design of a conventional exercise treadmill having fixed armrests and a motor mounted in the front of the main frame thereof. The improvement mainly consists in a main frame having on the bottom thereof a U-shaped base with fixed armrests and a pressure rod and a telescopic support tube pivotally coupled with the U-shaped base and the main frame. As a result, when folding the exercise treadmill, the main frame is urged by the compression energy release of the pressure rod to move to an upright position in juxtaposition with the fixed armrests so that the space occupied by the exercise treadmill can be decreased for the convenience in storage and delivery.

Another object of the invention is to provide a foldable exercise treadmill structure whose telescopic support tube can prevent the upright exercise treadmill from tumbling over. The telescopic support tube is equipped with movable steel balls to keep itself in an extended state so as to obtain stability and security.

DETAILED DESCRIPTION OF THE PREFERRED EMBODIMENTS

Figure 1:
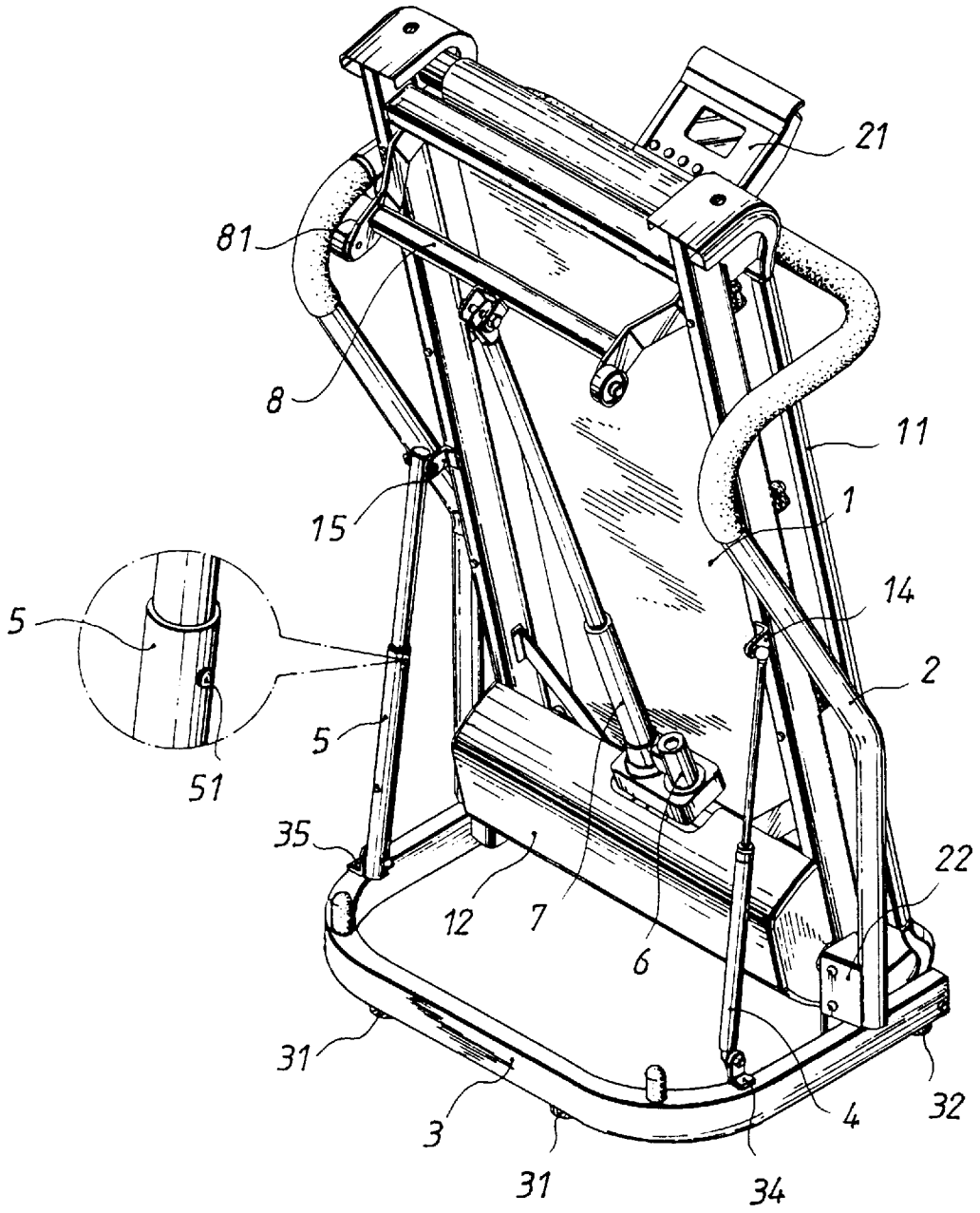
FIG. 1 is a perspective view showing a exercise treadmill according to the invention in an upright state.
Figure 2:
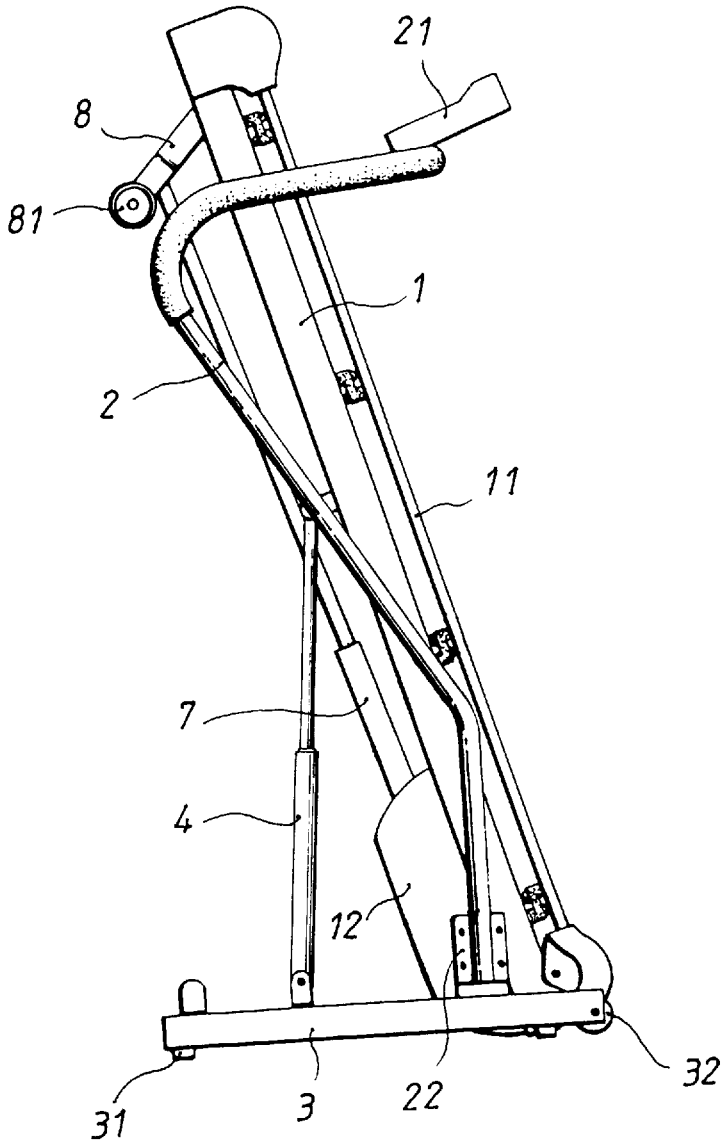
FIG. 2 is a side view of the exercise treadmill of FIG. 1.

As shown in FIGS. 1 and 2, a exercise treadmill according to the invention primarily consists of a main frame 1, armrests 2, a U-shaped base 3, a pressure rod 3, and a telescopic support tube 5.

The main frame 1 is provided with a belt 11 on its surface and a motor (not shown in drawings) installed in the front thereof and shielded with a cover 12. The above construction is generally similar to that of a conventional apparatus. However, the cover 12 is outfitted on its two sides with a bolt 13 whereby the cove can be attached to the U-shaped base 3. Further, two L-shaped lock plates 14 and 15 are individually disposed on the two sides of the main frame 1 so as to accommodate the ends of the pressure rod 4 and the support tube 5. In addition, the main frame 1 has a lifting device installed on the bottom thereof and driven by a screw rod. The lifting device mainly consists of a motor 6, a screw rod 7, and support means 8 having rollers 81. By means of the motor 6 driving the screw rod 7 to extend or retract, the inclination of the main frame 1 can be adjusted. The lifting device is known in the field and not a feature of the invention and thus it will not be detailed here.

The armrests 2 have a general inverted U-shaped pipe form and extend to couple with the front end of the main frame. On the upper end of each armrest 2 there is provided with a control panel 21 and on the lower end a lock plate 22 joining the armrest 2 with the U-shaped base 3.

Figure 4:
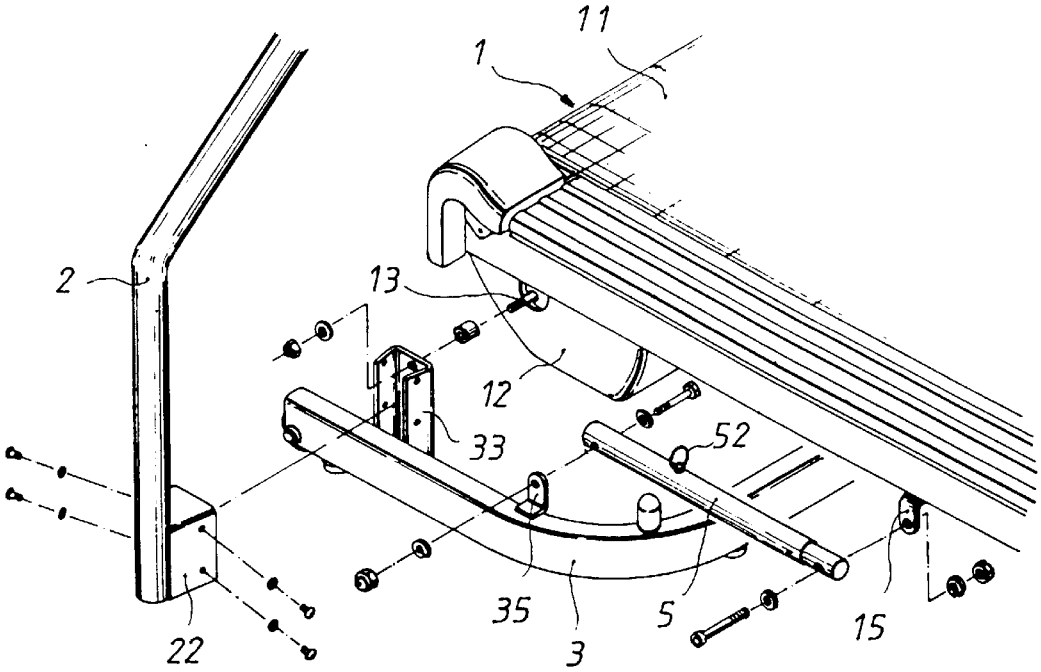
FIG. 4 is another exploded view showing the partial structure in the other side of the apparatus of FIG. 1.
Figure 5:
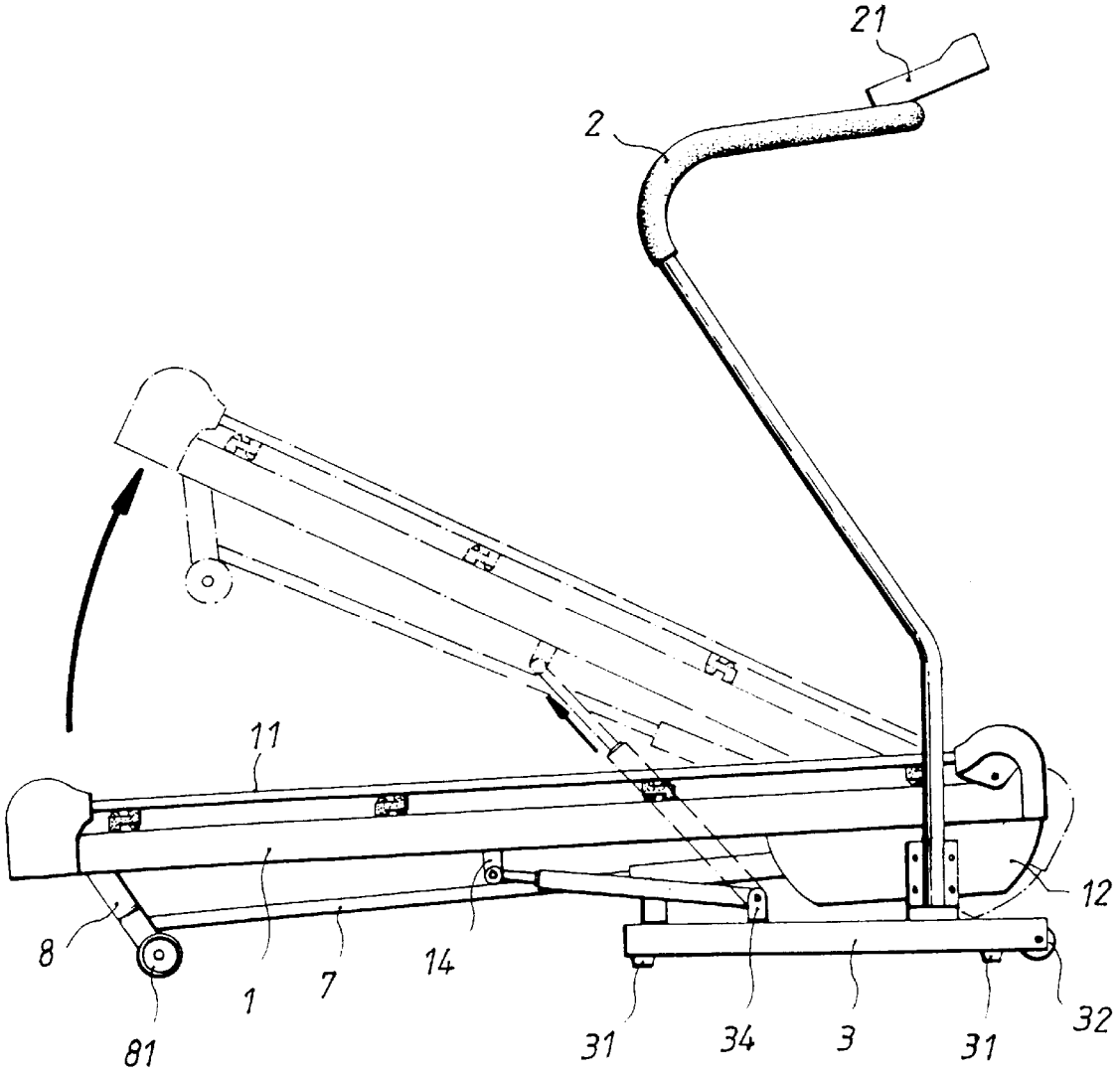
FIG. 5 schematically illustrates the movements of the apparatus according to the invention.

The U-shaped base 3 is a base with rising peripheral walls and a projecting connecting plate 33 formed at the front ends on two sides thereof and L-shaped lock plates 34 and 35 arranged near the corners to support ends of the pressure rod 4 and the telescopic support tube 5 (as shown in FIGS. 4 and 5). The connecting plate 33 is fastened by screws 331 to a corresponding lock plate 22 of the armrest 2. The bottom surface of the base 3 is provided with a plurality of frictional foot pads 31 and equipped with rollers 32 at the front end.

Figure 3:
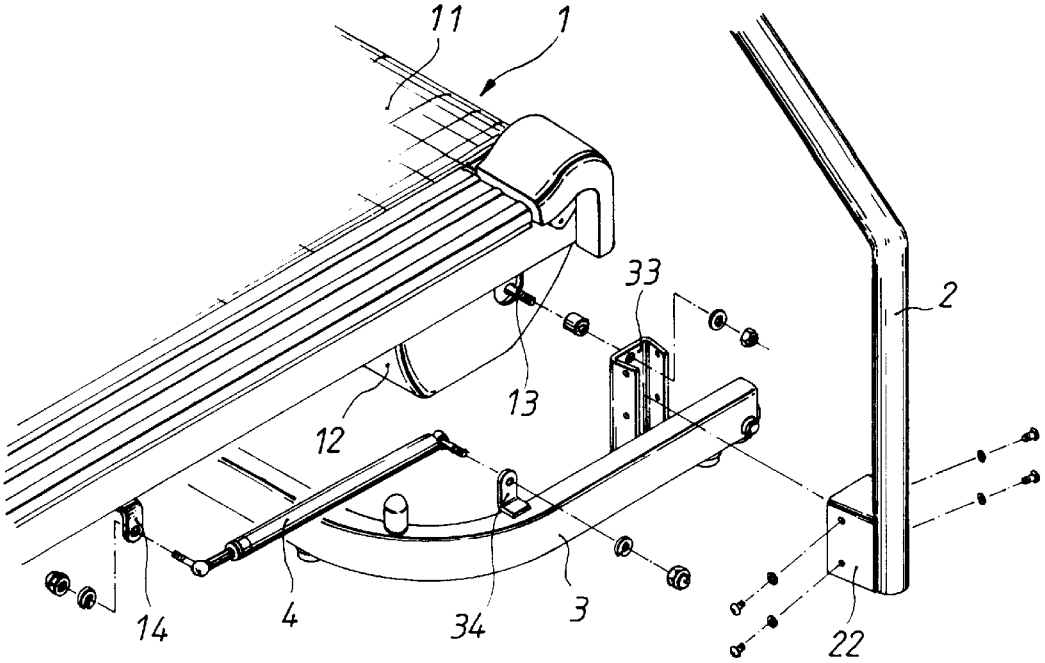
FIG. 3 is an exploded view showing the partial structure of the apparatus of FIG. 1.

The pressure rod 4 as shown in FIG. 3 provides a damping effect produced by pneumatic or hydraulic pressure and is connected at its two ends to the L-shaped lock plates 14 and 34 of the main frame 1 and the U-shaped base 3.

The telescopic support tube 5, as shown in FIG. 4, is composed of a plurality of sliding tubular parts, with a movable steel ball 51 serving as a detent to lock the support tube 5 in an extended state, and is connected at two ends to the lock plates 3. The extended support tube 5 can be shrunk by depression of the steel ball 51 to release the locked state and draw back sliding tubular parts in sequence.

According to the above description, the armrests 2 are fixed to the U-shaped base 3 and when in use the main frame 1 is placed horizontally. To fold the exercise treadmill, users lift the rear end of the main frame 1 to a predetermined inclination and then the pressure energy of the pressure rod 4 is released to slowly move the main frame 1 to turn upwardly as shown in FIG. 5. Finally the main frame 1 will reach a folded position juxtaposed with the armrests 2. Hence the exercise treadmill of the invention can reach the object of exercise treadmill the space it occupies when not in use for storage or delivery.

As the main frame 1 is folded, the tubular parts of the support tube 5 are drawn out to extend so that the movable steel ball 51 will automatically fall into an opening formed on the tube 5 to lock the tube in an extended state. As long as the steel ball 51 is not depressed, the folded exercise treadmill will not fall. Hence the steel ball provides a safety guard function. On the other hand, when users depress the steel ball 51 to release the locked state of the support tube, the sliding tubular parts can be pushed back in sequence.

The invention is characterized by the provision of a telescopic support tube 5. People who are skilled in the field can easily make alternative changes, such as a suitable length of support tube or rod with one end pivotally connected to the L-shaped lock plate 15 and the other end detachably locked to the L-shaped lock plate 35 of the U-shaped base, which can also achieve safe retention and obtain the same effect of preventing an upright exercise treadmill from falling over as the previously described embodiment. Such modifications are within the spirit and scope of the invention. Therefore, the illustrative embodiments described hereinbefore are to be construed as the examples of preferred application, not a limitation of the invention.

Further, the support tube 5 shown in FIG. 4 can be provided with a pin hole receiving a pin 52. The pin 52 is designed to prevent an inadvertent release of the pressure rod 4 caused by improper operation, handling, or transportation when the main frame is horizontally laid down. By means of the insertion of a pin 52 into the hole of the support tube 5, sliding tubular parts can be locked in an extended position until the pin 52 is removed.

What is claimed is:

1. A foldable exercise treadmill structure comprising:

a main frame provided with a belt on its surface, a motor arranged in the front thereof and shielded with a cover, and two L-shaped lock plates individually disposed on two sides so as to accommodate the ends of a pressure rod and a support tube, said cover being outfitted on its two sides with a bolt whereby the cover can be attached to a U-shaped base; an armrest having a general inverted U-shaped pipe form and extending to couple with the front end of said main frame, said armrest being further provided with a control panel on the upper end and a lock plate on the lower end to join with a U-shaped base;

a U-shaped base being a base including rising peripheral walls, a projecting connecting plate formed at the front end on two sides thereof, and L-shaped lock plates arranged near the corners to support ends of a pressure rod and a telescopic support tube, said connecting plate being fastened by screws to a corresponding lock plate of said armrest and the bottom surface of said base being provided with a plurality of frictional foot pads and equipped with rollers at the front end;

a pressure rod providing a damping effect to the movement of the exercise treadmill by pneumatic or hydraulic pressure and being connected at its two ends to the L-shaped lock plates of said main frame and said U-shaped base; and a telescopic support tube disposed between said main frame and said U-shape base to keep a folded exercise treadmill from falling, and characterized in that said armrest is fixed to said U-shaped base and said main frame is horizontally placed when in use, and in that when it is desired to fold the exercise treadmill, users can raise the rear end of said main frame to a specific inclination and then the energy stored in said pressure rod is released slowly to move said main frame to turn upwardly until it reaches a folded position juxaposed with said armrests.

2. A folded exercise treadmill structure as claimed in claim 1 wherein said telescopic support tube consists of a plurality of sliding tubular parts and is individually attached at its two ends to the L-shaped lock plates of said main frame and said U-shaped base, said support tube comprising a movable steel ball disposed at a proper position to lock said sliding tubular parts in an extended state.

3. A folded exercise treadmill structure as claimed in claim 2 wherein said telescopic support tube can be provided with a pin hole to receive a pin that is designed to lock said plurality of sliding tubular parts in positions to disable said pressure rod.

* * * * *